US006752197B2

(12) United States Patent
Mortari

(10) Patent No.: US 6,752,197 B2
(45) Date of Patent: Jun. 22, 2004

(54) INJECTOR PARTICULARLY FOR VACUUM DIE-CASTING APPARATUS

(75) Inventor: Graziano Mortari, Brescia (IT)

(73) Assignee: Idra Presse S.p.A., Brescia (IT)

( * ) Notice: Subject to any disclaimer, the term of this patent is extended or adjusted under 35 U.S.C. 154(b) by 0 days.

(21) Appl. No.: 09/878,216

(22) Filed: Jun. 12, 2001

(65) Prior Publication Data

US 2001/0052403 A1 Dec. 20, 2001

(30) Foreign Application Priority Data

Jun. 20, 2000 (IT) ..... PD2000A0167

(51) Int. Cl.[7] ..... B22D 17/10; B22D 27/00; B22D 27/15; B22D 43/00

(52) U.S. Cl. ..... 164/61; 164/66.1; 164/113; 164/149; 164/158; 164/254; 164/259; 164/312

(58) Field of Search ..... 164/149, 158, 164/61, 62, 63, 65, 66.1, 113, 253, 254, 312, 259

(56) References Cited

U.S. PATENT DOCUMENTS 3,009,218 A 11/1961 Rearwin
4,223,718 A 9/1980 Miki et al.
4,633,930 A 1/1987 Behrens
5,860,468 A * 1/1999 Cook ..... 164/61
6,024,158 A 2/2000 Gabathuler et al.

FOREIGN PATENT DOCUMENTS

FR 1 303 198 A 1/1963

OTHER PUBLICATIONS

Patent Abstracts of Japan vol. 009, No. 319 (M–439), Dec. 14, 1985 *abstract*.

* cited by examiner

*Primary Examiner*—Kuang Y. Lin
(74) *Attorney, Agent, or Firm*—Guido Modiano; Albert Josif; Daniel O'Byrne

(57) ABSTRACT

An injector particularly for a vacuum die-casting apparatus, comprising an injector body provided with at least one first opening for injecting/aspirating a protective gas and at least one second opening for loading molten material, which are arranged in order of operation. The injector body is further provided with a chamber for containing material and for the sliding of a piston for pushing the material into a die. The injector also comprises elements for cleaning and lubricating the external surface of the piston which are arranged in order of operation on a corresponding supporting element which is separate from the injector body.

10 Claims, 4 Drawing Sheets

INJECTOR PARTICULARLY FOR VACUUM DIE-CASTING APPARATUS

BACKGROUND OF THE INVENTION

The present invention relates to an injector particularly for a vacuum die-casting apparatus.

In recent years, light alloys are being used increasingly to manufacture structural components and/or elements, such as for example chassis and body components of assembly-line vehicles.

The die-casting process consists in keeping the material in the molten state in a holding furnace, in subsequently transferring a specific amount thereof into an injector for injection in a die, and in finally cooling the resulting casting.

In vacuum die-casting, a vacuum is produced before introducing the molten material in the die.

In terms of plant maintenance and amortization costs, the die-casting process is highly advantageous if it relates to the production of large batches meant for high-volume mass-manufacturing lines.

Standard die-casting apparatuses, however, are scarcely suited for the production of vehicle frame or body components due to their brittle fracture behavior and to the porosity of the resulting castings.

It is in fact currently impossible to produce Al—Mg alloy castings, since castings full of porosities are obtained, with a high number of gas inclusions.

Brittle fracture, porosity and inclusions are unacceptable in castings which should be welded and which are required, in various forms, to have high plastic deformation properties.

The main limitations of the die-casting plants currently in use include the structure of the injectors used and the injection technique.

Injectors currently in use are constituted by an injector body provided with an opening for loading the liquid material and with a chamber for containing the material and for the sliding of a piston for injecting the material into the dies.

A lubricant is usually introduced in the containment chamber.

However, the lubrication of the chamber cannot be controlled and is therefore unreliable from the point of view of the process.

The presence of residues of lubricating material produces porosities and/or the formation of oxides which no longer ensure the quality of the casting.

Moreover, during the loading of the molten material into the chamber of the injector body the material is continuously in contact with a contaminating atmosphere which can cause the generation of oxides and therefore the formation of gas inclusions inside the casting.

Another cause of porosities and inclusions is the turbulence of the liquid material which is caused when the material is poured into the injector body.

SUMMARY OF THE INVENTION

The aim of the present invention is to solve or substantially reduce the problems of conventional injectors.

Within this aim, an object of the present invention is to provide an injector by virtue of which it is no longer necessary to introduce lubricating material inside the injector body in the containment chamber.

Another object of the invention is to provide an injector by virtue of which it is possible to work in a protective gas atmosphere.

Another object of the invention is to provide an injector which allows to produce equally thin-walled or thick-walled die castings.

Another object of the invention is to provide an injector which allows to use innovative alloys which otherwise cannot be used in conventional apparatuses.

This aim and these and other objects which will become better apparent hereinafter are achieved by an injector particularly for a vacuum die-casting apparatus, characterized in that it comprises an injector body provided with at least one first opening for injecting/aspirating a protective gas, and at least one second opening for loading molten material, which are arranged in order of operation, said injector body being further provided with a chamber for containing material and for the sliding of a piston for pushing the material into a die, said injector comprising means for cleaning and lubricating the external surface of the piston which are arranged in order of operation on a corresponding supporting element which is separate from the injector body.

BRIEF DESCRIPTION OF THE DRAWINGS

Further characteristics and advantages of the present invention will become better apparent from the following detailed description of a preferred but not exclusive embodiment thereof, illustrated only by way of non-limitative example in the accompanying drawings, wherein.

DESCRIPTION OF THE PREFERRED EMBODIMENTS

Figure 1:
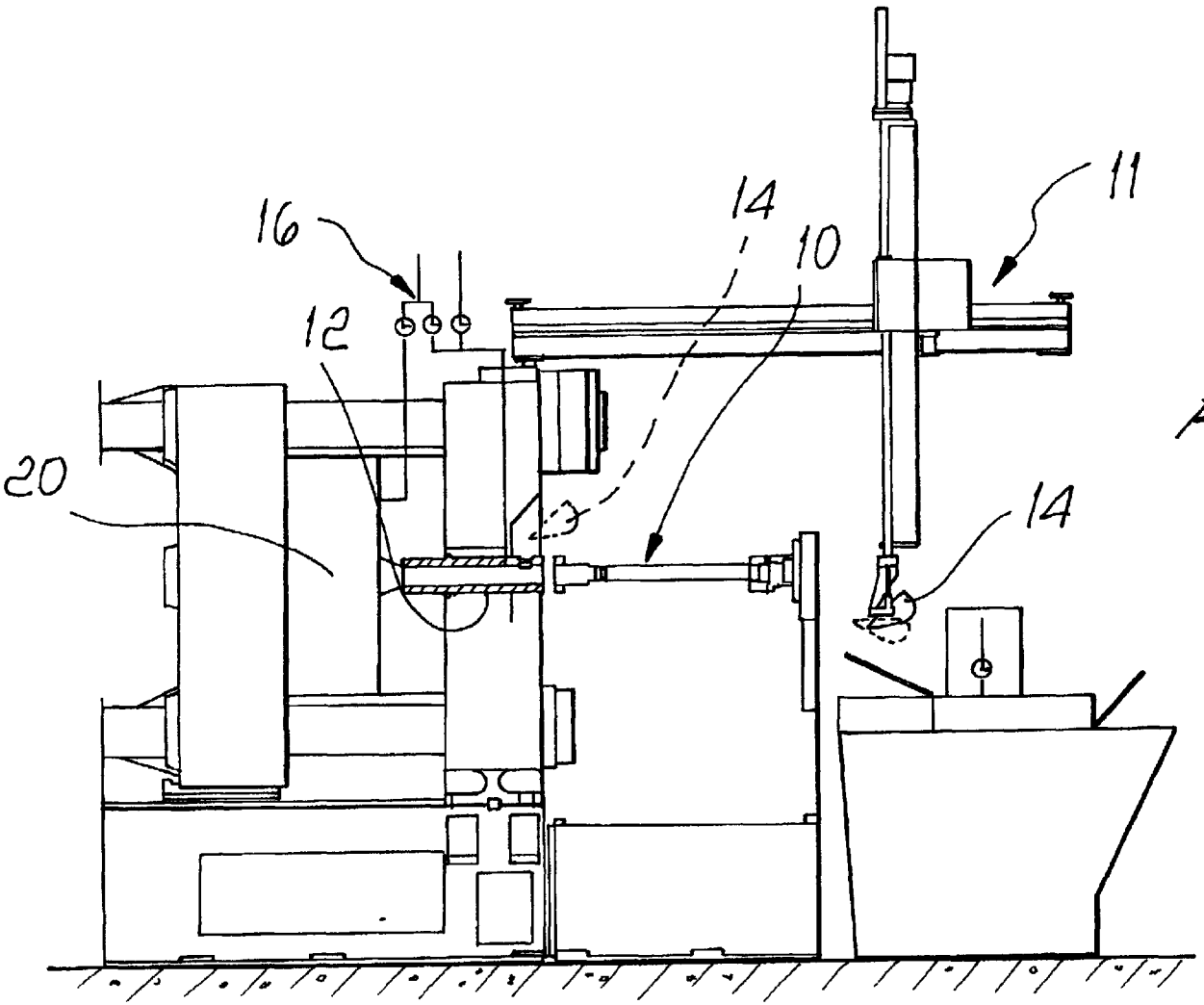
FIG. 1 is a side view of a pressure die-casting plant which uses an injector according to the invention.
Figure 2:
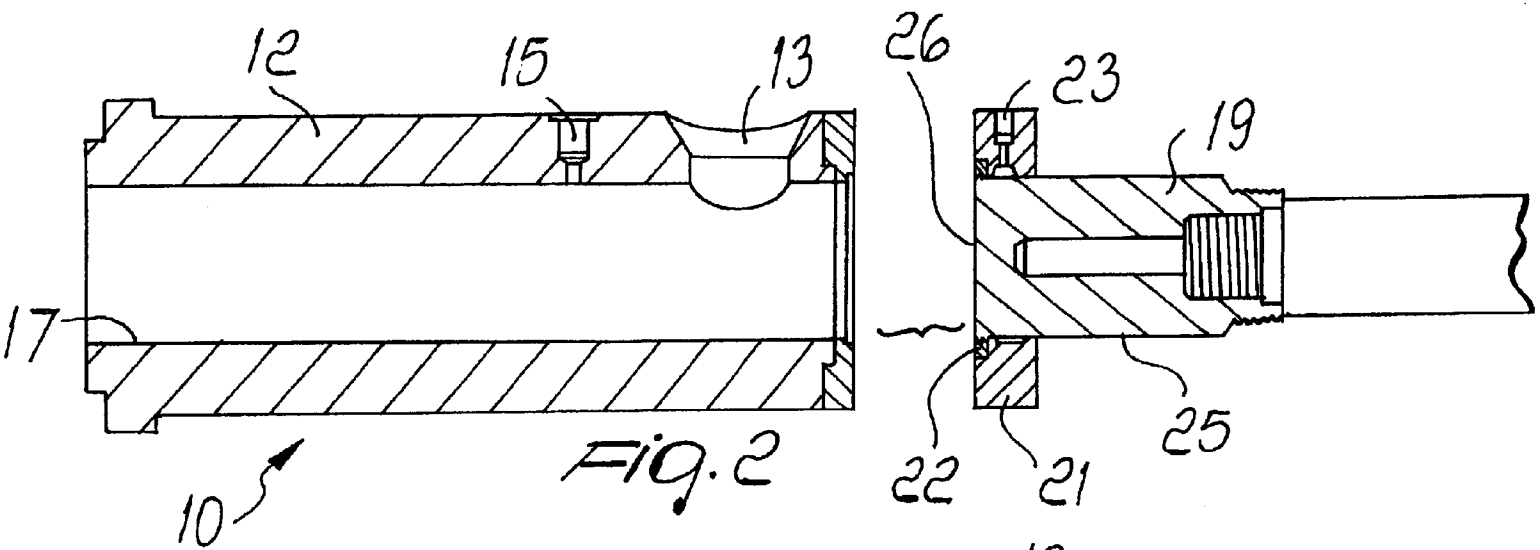
FIGS. 2 to 6 are sectional views of an injector according to the invention in its operating sequence.
Figure 3:
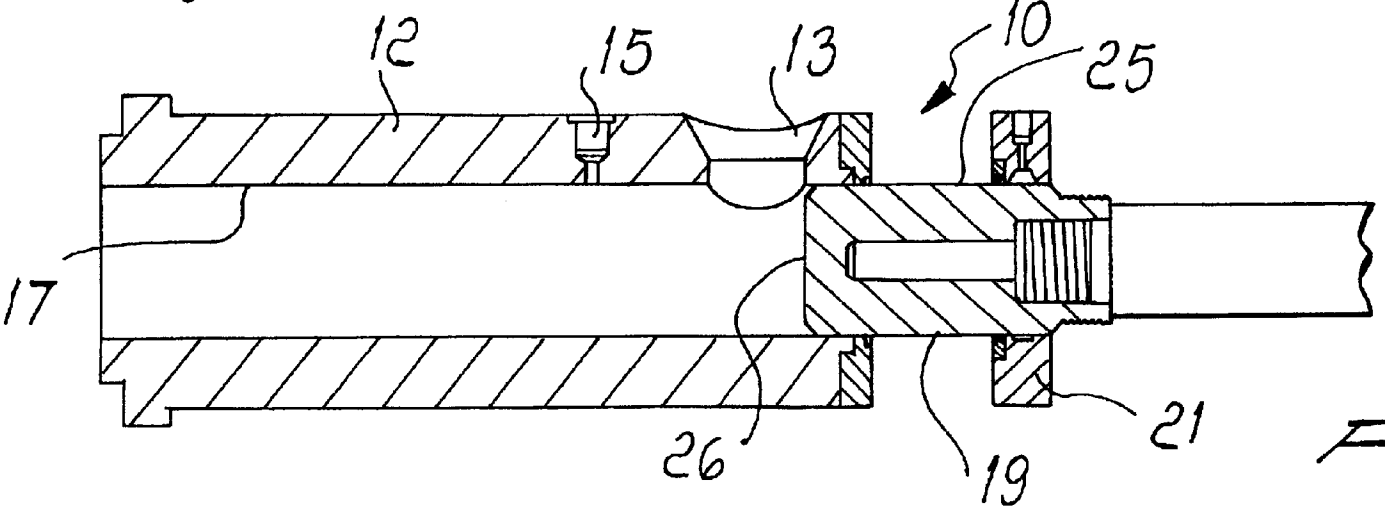
Figure 4:
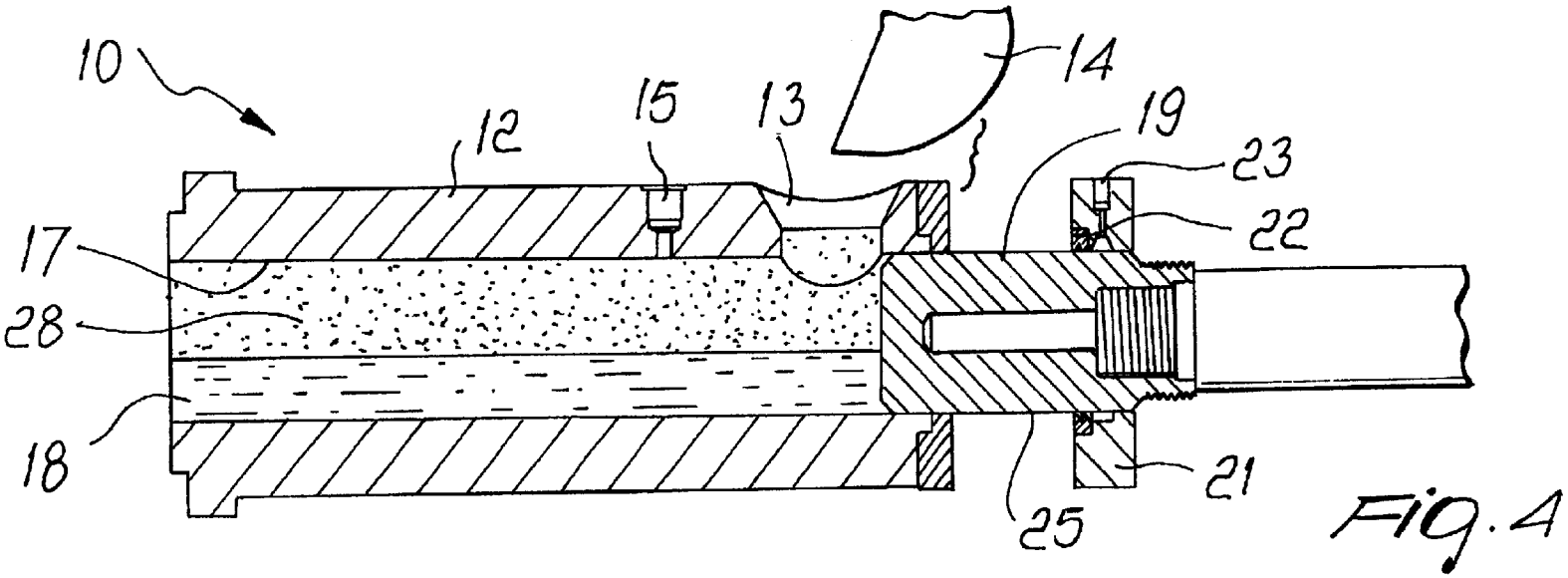
Figure 5:
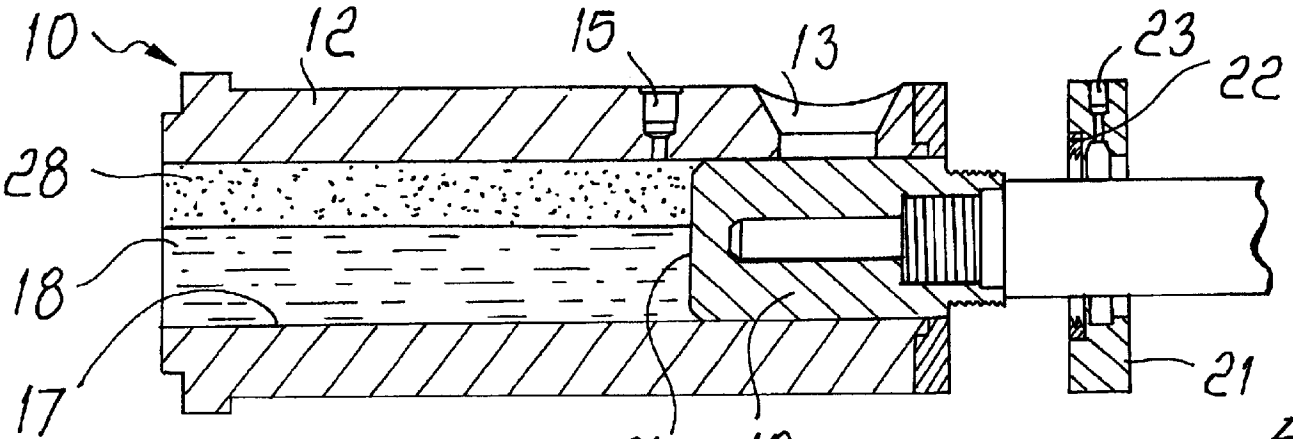
Figure 6:
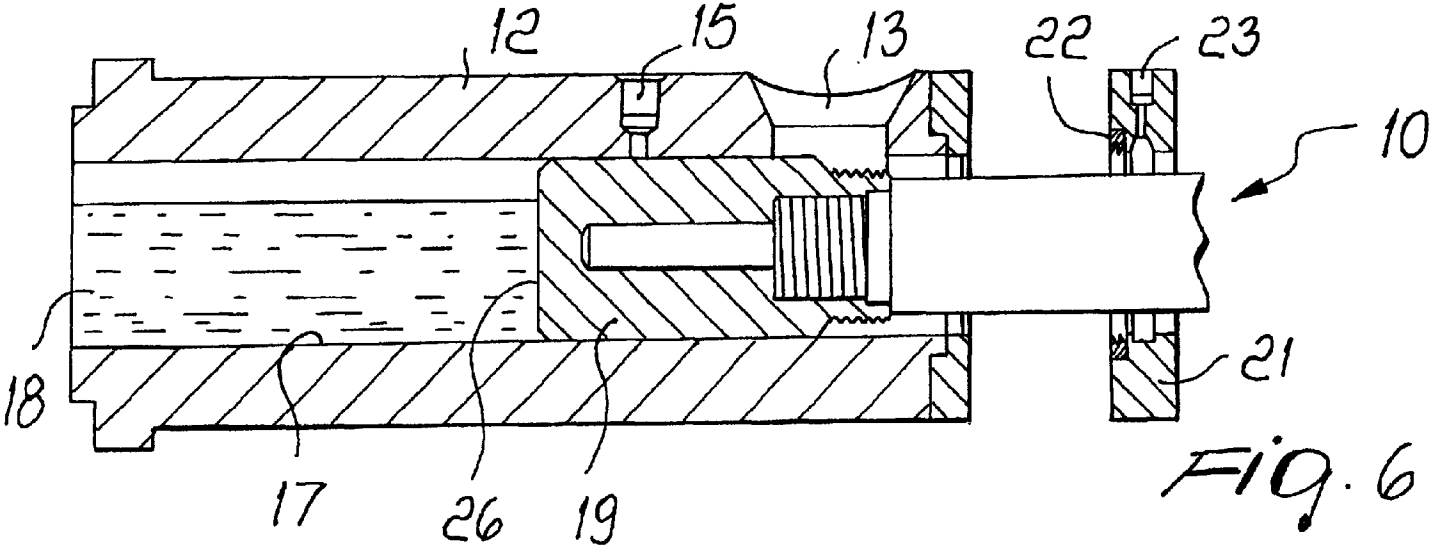
Figure 7:
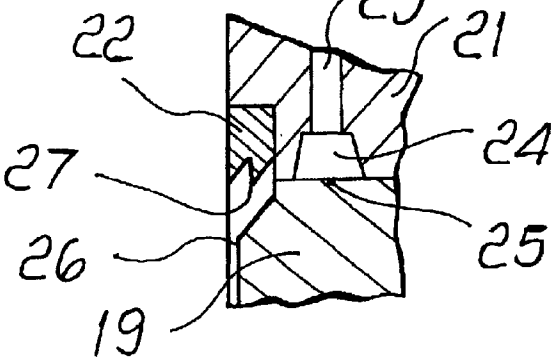
FIG. 7 is a view of a detail of the injector shown in the preceding figures.

With particular reference to the figures, an injector according to the invention is generally designated by the reference numeral 10.

As shown in FIG. 1, the injector 10 is inserted in a vacuum die-casting apparatus, generally designated by the reference numeral 11.

The injector 10 is constituted by an injector body 12 which has, in an upward region, at least one first opening 13 for loading molten metallic material, generally designated by the reference numeral 18, by means of a ladle 14, and at least one second opening 15 for introducing/aspirating protective gas 28 and for generating a vacuum, which is connected to ducts, generally designated by the reference numeral 16, which are part of a pressurized circuit.

The injector body 12 is further provided with a chamber 17 for containing the molten material 18 and for the sliding of a piston 19 for injecting the material 18 into dies 20.

The injector 10 comprises means for cleaning and lubricating an outer surface 25 of the piston 19.

Such means are associated with a plate-like supporting element 21 which also acts as a guide and a support for the piston 19, is arranged coaxially to the chamber 17, faces the injector body 12 and is spaced from it.

The cleaning means are constituted by a scraper ring 22, while the lubricating means are constituted by a nozzle 23 for injecting lubricating material which is arranged radially to the piston 19 at a circumferential groove 24.

The cleaning means and the lubrication means are arranged in order of operation, i.e., the scraper ring 22 is arranged after the circumferential groove 24 with respect to the advancement direction of the piston 19.

The operating steps of the injection process are illustrated effectively in FIGS. 2 to 6.

When the piston 19 is fully retracted, its head end 26 is arranged at the supporting element 21.

When the piston 19 advances, the nozzle 23 lubricates the outer surface 25, allowing its sliding within the chamber 17.

Proximate to the loading opening 13, the piston 19 stops its motion.

At this point, by means of a ladle 14, the molten material 18 is poured into the containment chamber 17 and remains constantly in an atmosphere of protective gas 28, advantageously nitrogen.

In the meantime, more protective gas is introduced from the opening 15 through the ducts 16 into the chamber 17.

The piston 19 can remain in this injection locking position for a preset time interval or until a preset amount of material 18 has been introduced in the chamber 17.

The piston 19 then continues to advance, continuing the injection.

Since loading molten material 18 without controlling the filling rate can cause turbulences within the material and therefore generate inclusions, the ladle 14 is provided with a system for controlling its tipping rate or the filling rate of the chamber 17 so as to avoid turbulences.

Once the piston 19, by way of its advancement, has completely closed the opening 13, the protective gas is aspirated from the opening 15 until a vacuum is generated inside the chamber 17.

Once the piston 19 has closed the opening 15 as well, injection can be completed by injecting all the material 18 into the dies 20.

After the holding period, the piston 19 can advance at an adjustable rate so as to perform injection with a high die filling rate in the case of thin-walled die-castings or with a low die filling rate in the case of thick-walled die-castings.

At the end of the injection, the piston 19 retracts and the scraper ring 22 cleans its outer surface 25, eliminating any residues of material which would contaminate a subsequent casting.

After the scraper ring 22 along this direction of motion of the piston 19 there is the nozzle 23, which lubricates the clean surface 25, preparing the piston 19 for a new injection step.

Finally, it should be noted that the particular shape of the circumferential lips 27 of the scraper ring 22, which have a saw-tooth plan shape, allows effective cleaning of the piston when said piston retracts but leaves a film of lubricant when said piston advances.

In practice it has been observed that the present invention has achieved the intended aim and objects.

The injector 10 in fact allows to lubricate the piston without introducing a release agent/lubricant in the injector body.

This allows to obtain die castings without gas inclusions and/or allows optimization as regards elongation, since residues of lubricating material cause porosities and/or the formation of oxides which do not ensure the quality of the casting.

Effective control of the speed of the piston further allows to obtain both thin-walled and thick-walled die castings.

It is important to note that the molten material is constantly in an atmosphere of protective gas, advantageously nitrogen, which protects it from the formation of oxides and inclusions.

Finally, an important consequence is the possibility to use innovative alloys, such as Al—Mg alloys.

The present invention is susceptible of numerous modifications and variations, all of which are within the scope of the inventive concept.

The technical details may be replaced with other technically equivalent elements.

The materials and the dimensions, so long as they are compatible with the contingent use, may be any according to requirements.

The disclosures in Italian Patent Application No. PD2000A000167 from which this application claims priority are incorporated herein by reference.

What is claimed is:

1. An injector for a vacuum die-casting apparatus, comprising: an injector body which encloses a containment chamber for containing injection material and is provided with at least one first opening for loading molten material in said chamber and at least one second opening for injecting in and, respectively, aspirating protective gas from said chamber, said first and second openings being arranged on said injector body in order of operation; an injection piston movable with a sliding motion in said chamber for pushing the molten material into a die of the die-casting apparatus, said piston comprising an external surface and a head end thereof; a supporting element, which is arranged separate from, and coaxial to said chamber and acts as a guide and support for the piston during motion thereof among a retracted position, in which the head end is arranged at the supporting element, and advanced positions, in which the piston advances in the chamber to allow loading of molten material in said chamber and for injecting the loaded molten material, respectively, and back to the retracted position; cleaning and lubricating means arranged in order of operation on said supporting element so as to provide cleaning and lubricating of the whole external surface of the piston upon movement thereof among said retracted and, respectively, said advanced positions.

2. The injector of claim 1, wherein said supporting element is constituted by a plate-like element for guiding and supporting the piston, which has a circumferential groove that is arranged radially to the piston.

3. The injector of claim 2, wherein said cleaning means is constituted by a scraper ring provided with circumferential lips having a saw-tooth cross-sectional shape, which is located at said supporting element.

4. The injector of claim 3, wherein said lubricating means are constituted by at least one lubricant injection nozzle which is arranged at said groove of the supporting element, radially with respect to the piston.

5. The injector of claim 4, wherein said scraper ring is arranged downstream of said groove with respect to an advancement direction of the piston.

6. The injector of claim 5, wherein said second opening is arranged downstream of said first opening with respect to the piston advancement direction.

7. The injector of claim 6, further comprising a pressurized protective-gas circuit connected to said second opening.

8. An injector for a vacuum die-casting apparatus, comprising: an injector body which encloses a containment chamber for containing injection material and is provided with at least one first opening for loading molten material in said chamber and at least one second opening for injecting in and, respectively, aspirating protective gas from said chamber, said first and second openings being arranged on said injector body in order of operation; an injection piston movable with a sliding motion in said chamber for pushing the molten material into a die of the die-casting apparatus, said piston comprising an external surface and a head end thereof; a supporting element, which is arranged separate from, and coaxial to said chamber and acts as a guide and support for the piston during motion thereof among a retracted position, in which the head end is arranged at the supporting element, and advanced positions, in which the piston advances in the chamber to allow loading of molten material in said chamber and for injecting the loaded molten material in the die, respectively, and back to the retracted position, said supporting means being constituted by a plate-like element which has a circumferential groove that is arranged radially to the piston; lubricating means for lubricating the external surface of the piston, which is constituted by at least one lubricant injection nozzle arranged at said groove of the supporting element, radially with respect to the piston; and cleaning means for cleaning the external surface of the piston, which is constituted by a scraper ring provided with circumferential lips having a saw-tooth cross-sectional shape, said lubricating and cleaning means being located at said supporting element, arranged in order of operation so as to provide cleaning and lubricating of the whole external surface of the piston upon movement thereof among said retracted and, respectively, said advanced positions.

9. The injector of claim 8, wherein said scraper ring is arranged downstream of said groove with respect to an advancement direction of the piston.

10. A method for injection of molten material in a die of a vacuum die-casting apparatus, comprising the steps of:

providing an injector comprising an injector body enclosing a containment chamber for containing injection material which is provided with at least one first opening for loading molten material in said chamber and at least one second opening for injecting in and, respectively, aspirating protective gas from said chamber, the first and second openings being arranged on said injector body in order of operation, an injection piston movable with a sliding motion in said chamber for pushing the molten material into a die of the die-casting apparatus, the piston comprising an external surface and a head end thereof, a supporting element arranged separate from, and coaxial to the chamber and acting as a guide and support for the piston during movement thereof, and cleaning and lubricating means arranged in order of operation on the supporting element so as to provide cleaning and lubricating of the whole external surface of the piston;

connecting the injector, in a material injection configuration, with a die of a die-casting apparatus;

moving the piston from a retracted position, in which the head end thereof is arranged at the supporting element, to an advanced position in the containment chamber, in which the piston allows loading of molten material in said containment chamber through said first opening;

introducing material in a molten state, in a protective-gas atmosphere, in the containment chamber of the injector body, while the piston is motionless in said advanced position for a controlled tune period;

aspirating protective gas from said chamber through said second opening until a vacuum is generated in the die and in the chamber;

moving the piston to a further advanced position in said containment chamber for injecting the molten material into the die;

lubricating the external surface of the piston during advancement thereof;

holding the piston in the further advanced position to allow cooling of the molten material injected in the die; and retracting the piston to the retracted position, with the head end arranged at the supporting element, while carrying out a complete cleaning of the external surface thereof by way of the cleaning means.

* * * * *